United States Patent [19]

Murai

[11] Patent Number: 5,012,053

[45] Date of Patent: Apr. 30, 1991

[54] CONTACT DEVICE FOR A SWITCH

[75] Inventor: Wasaburo Murai, Osaka, Japan

[73] Assignee: Terasaki Denki Sangyo Kabushiki Kaisha, Osaka, Japan

[21] Appl. No.: 326,283

[22] Filed: Mar. 21, 1989

[30] Foreign Application Priority Data

Mar. 24, 1988 [JP] Japan ..... 63-68241

[51] Int. Cl.[5] ..... H01H 3/60; H01H 1/52

[52] U.S. Cl. ..... 200/288; 200/319

[58] Field of Search ..... 200/288, 319, 400, 401, 200/196, 244; 335/16, 192, 195

[56] References Cited

U.S. PATENT DOCUMENTS

| | | | |
|---|---|---|---|
| 3,646,488 | 2/1972 | Iida et al. | 335/195 |
| 4,129,762 | 12/1978 | Bruchet | 200/153 |
| 4,219,740 | 8/1980 | Batteux et al. | 335/195 |
| 4,468,533 | 8/1984 | Kodera et al. | 200/153 |
| 4,472,701 | 9/1984 | Bellows et al. | 335/23 |

*Primary Examiner*—Henry J. Recla
*Assistant Examiner*—David J. Walczak

[57] ABSTRACT

A contact structure of a switching device having a pivoted movable contact arm for reducing contact chatter, i.e., bounce, at the instant of closing or separation is given. Such chatter is mainly caused by clearances existing around pivots of the movable contact arm and operating mechanisms. A contact spring for applying a contact pressure when the switch is closed is provided between a portion of the movable contact arm at the other side of a contact in relation to the pivot of the movable contact and a stationary portion of the switching device. Also, a stopper is provided on a contact arm support member engagable with the contact arm at a side of the contact. With structure the movable contact arm and operating mechanisms are perfectly biased by the contact spring always in one direction and prevents free movement of the movable contact arm.

5 Claims, 9 Drawing Sheets

CONTACT DEVICE FOR A SWITCH

BACKGROUND OF THE INVENTION

The present invention relates to a contact structure for a switching device, in particular to a contact structure for a switching device forming a butt type, in which contact chatter at the instant of contact separation or closing caused by clearances in the mechanism, is improved to be eliminated.

Generally, the contact operating members of mechanical switching devices often consist of a combination of movable contact members forming a butt-contact and some type of link mechanism such as a toggle link mechanism for operation. A contact spring is used to exert contact pressure upon closing of the contact.

However, as there are small clearances around each of the pivots which are used for connecting or interconnecting movable contact members forming a butt-contact and operating link mechanism, and as their clearances are totalized at the point of contact, i.e. the free end of the movable contact member arm, a remarkable amount of free movement is produced regardless of the contact spring force and chattering or bounce of the contacts at the instant of contact separation or closing is bound to occur. That is, imperfect contact is present at that moment even though a sufficient amount of contact force is being applied to the contact members by the contact spring upon completion of the closing. Such chattering or bounce tends to increase arcing at each occurrence of switching and can lead to serious wear and roughness on the contacting surfaces. Furthermore, when the switching device closes or interrupts a short-circuit current, the heavy electro-magnetic repulsive forces produced by the current act on the movable contact member arm and are superimposed on that chattering, so that such imperfect contact, in extreme conditions, may result in contact welding.

Conventionally, several means have been taken in order to cancel such repulsive forces. Making circular loop circuits with a flexible conductor connected to the movable contact arms, as illustrated in the Figures of the embodiment of the present application, is one of the simplest and most reliable means to overcome such problems. However even if such means are introduced to the contact structure, the repulsive movement can not be cancelled at the instant of contact separation or closing if there are clearances on the pivot since such free movement at the pivot and the structure do not work as an exact pivoting movement at such instants. Thus, the chattering or bounce will still be serious although such structures are used.

Therefore it is very important for switching devices which deal with heavy short-circuit currents to eliminate such mechanical chattering or bounce caused by the clearances in the pivots in the mechanism.

In FIGS. 7, 8 and 9 respective cross-sectional side views of various basic conventional examples of the relationship between a movable contact arm and spring arrangements are shown. In FIGS. 8A and 9A the diameters of the apertures around each pivot are shown in exaggerated form to clearly indicate on which side the aforementioned clearances appear in the arrangement of FIGS. 8 and 9 respectively FIGS. 10 and 11 are cross sections taken along lines X—X and XI—XI in FIG. 8 and FIG. 9 respectively.

As shown in FIGS. 7 to 9 of the drawings, a contact device of a conventional electric switch includes a stationary contact rod 101, a stationary contact 102, a movable contact arm 103, a movable contact 104, a movable contact support member 105 and an operating link 106 unitarily connected together by the movable contact arm 103 and a pivot 107, a stopper given reference numeral 110 for FIG. 7, 110' for FIG. 8, and 110'' for FIG. 9 for the movable contact arm 103 provided on the movable contact support member 105, a spring 111 engaged with the movable contact arm 103, and a flexible conductor 112 connected with the end portion of the movable contact arm 103 The systems of supporting the spring 111 can be classified broadly into systems where the spring is provided between the movable contact support member 105 and the movable contact arm 103 as shown in FIG. 7, and a system where the spring is provided between the movable contact arm 103 and a stationary member 113 as shown in FIGS. 8 and 9.

In the system shown in FIG. 7, where the spring 111 is located between the movable contact support member 105 and the movable contact arm 103, the force of the spring 111 does not influence the operating mechanism including the operating link 106 and thus the clearance between the pivot 107 connecting the operating link 106 and the apertures of the movable contact support member 105 and operating link 106 can not be biassed by this spring 111. In this system, chattering is always present to some extent.

Furthermore, in the system shown in FIGS. 8 and 9, the movable contact 104 is provided at one side of the pivot 107 and the spring 111 is provided at the other side on the movable contact arm 103. Also the spring 111 is a pressure spring provided on the stationary member 113, usually an insulator mounting base, and operates to impart a contact pressure under closed conditions and a bias towards the direction for opening the movable contact arm 103. By providing the spring 111 in this way, the clearance between the pivot 107 connecting the operating link 106 and the aperture of the movable contact support member 105 is perfectly biassed. Therefore, chattering is naturally decreased to some extent.

The condition of the clearances around the pivots are illustrated in FIG. 8A and FIG. 9A. In these figures, 103A is the aperture of the movement contact arm 103, 105A and 105B are the apertures of the movable contact support member 105, 106A is for the operating link 106, and 108A is for the support member 108.

However, with such prior devices, even though the spring 111 is provided between the movable contact arm 103 and the stationary member 113 shown in FIGS. 8 and 9, the clearance still appears in the movable contact arm itself, and chattering can not be perfectly eliminated.

That is, with either of the contact devices shown in FIGS. 8 and 9, the stoppers 110', 110'' are respectively located at the side of the spring 111 in relation to the pivot 107 of the movable contact arm 103. In FIG. 8 the stopper 110' is located at a position intermediate of the pivot 107 of the movable contact arm 103 and the spring 111, and in FIG. 9 the stopper 110'' is located at the end of the movable contact arm 103 which is further away from the spring 111. In either case, a contacting force F is expressed by the following formula:

$$F = P \times L_1 / L_2$$

where, the operating force of the spring 111 is P, the distance between the pivot 107 and the spring 111 is $L_1$, and the distance from the pivot 107 to the center of the movable contact 104 is $L_2$.

However, in the prior construction shown in FIG. 8 and FIG. 10, the clearance between the aperture of the movable contact arm 103 and the pivot 107 appears below the pivot 107, and the movable contact arm 103 rotates with the stopper 110' substantially at the beginning of contact until such clearance disappears, so that contact pressure F' during that time can be expressed by the following formula:

$$F = P \times (D - C)(C/D < 1)$$

where the operating force of the spring is P, the distance from the stopper 110' to the spring 111 is C and the distance from the spring 111 to the center of the movable contact 104 is D. From the above formula there is a disadvantage in that the instantaneous contact pressure F' is considerably lower than the desired contact pressure F.

Also, in the prior construction shown in FIG. 9 and FIG. 11, the clearance 115 between the aperture 103A of the contact arm 103 and the pivot 107 appears above the pivot 107. Thus, at the beginning of the contact, the movable contact seems to be biased toward the desired direction to cancel the clearance around the pivot 107. In this construction, the force Q for pressing the pivot 107 by the movable contact arm 103 is expressed by the following formula:

$$Q = P \times A/B$$

where the operating force of the spring 111 is P, the distance between the stopper 110 and the spring 111 is A, and the distance between the stopper 110 and the pivot 107 is B.

However, even with this construction the movable contact arm takes on a considerably unstable condition since the factor $A/B < 1$ and the mechanical resistance R of the flexible conductor 112, which is used for connection with a stationary part of the switch tend to bias the end portion of the movable contact arm upwardly as shown in FIG. 9, at or near the closed position, and when the stopper 110 is located between the spring 111 and the connected portion of flexible conductor 112, such resistance opposes the force P. This results in the closing instantaneous pressure being substantially reduced or disappearing. So, this is the disadvantage of this construction. However, with the construction previously mentioned as shown in FIGS. 1 and 8, such resistance always tend to assist the spring 111 and can be ignored.

SUMMARY OF THE INVENTION

Thus, the object of the present invention is to provide a contact structure for a switching means employing a batt type contact and having a construction including a spring means provided between a movable contact member and a stationary member wherein all of the clearances in the movable contact member as well as in the operting link are eliminated to insure a sufficient closing instantaneous pressure at the instant of closing or separation.

Therefore, in order to establish the above mentioned object, in accordance with the present invention a contact device of a switch is constituted with a contact structure for a switching device comprising a stationary contact rod having a stationary contact, a movable contact arm rotatably supported by a pivot on a movable contact support member and having a movable contact at one side of the movable contact arm in relation to the pivot and connected with a fixed conductor through a flexible conductor to make or break an electric path when the switching device is closed or opened, a mechanical link means engaging with the movable contact support member to form a movement of the movable contact support member as well as the movable contact arm to make and break an electric path when the switching device is closed or opened, a spring means provided between the other side of the movable contact arm and a stationary portion of the switching device to bias the movable contact arm toward a direction for engaging the movable contact with the stationary contacts, for closing the movable and stationary contact in the closed condition, and to bias the movable contact support member toward opening through the pivot, a stopper means provided on the movable contact support member to restrict the movement of the movable contact arm on the movable contact support arm when the switching device is opened, the stopper means also being located and engaged with the movable contact arm at that one side of the movable contact arm

DESCRIPTION OF THE DRAWINGS

The invention will be explained in conjunction with the illustrative embodiments shown in the accompanying drawings, in which:

FIG. 5 is a cross-sectional side view of a closing condition, FIG. 6 is a cross-sectional side view of a opening condition;

DESCRIPTION OF PREFERRED EMBODIMENTS OF THE INVENTION

Figure 1:
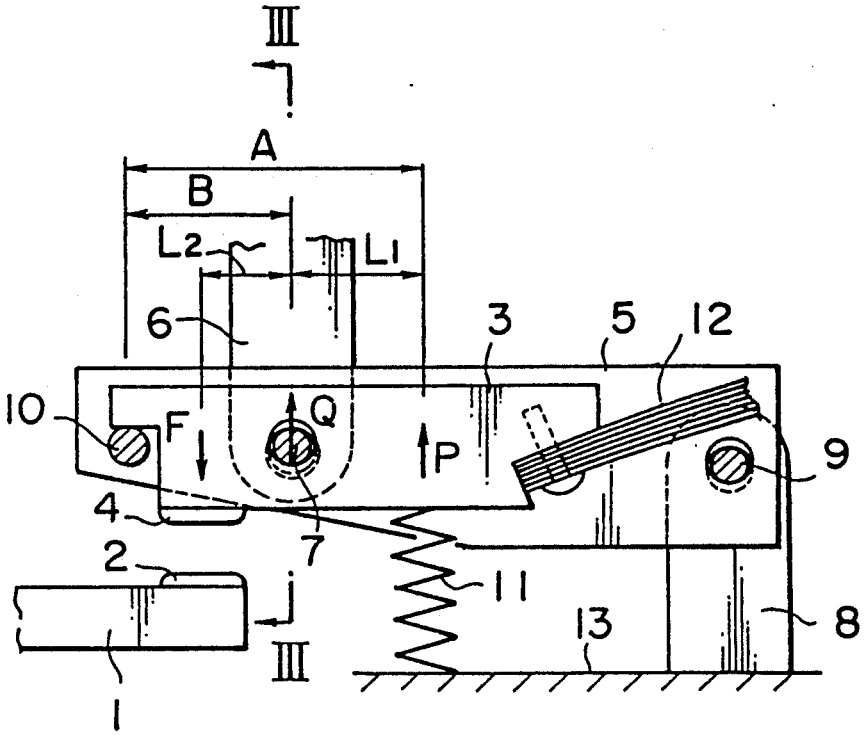
FIG. 1 and FIG. 2 of the drawings are side sectional views respectively showing the basic form of the present invention.
Figure 2:
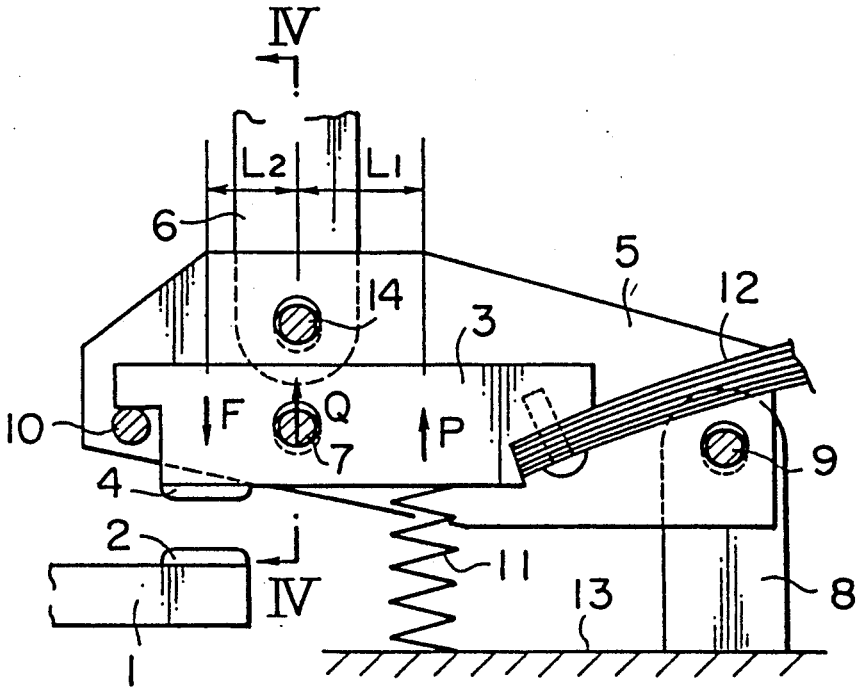

As shown in FIG. 1 and FIG. 2, a contact part of a switching device of the present invention is constituted from a stationary contact rod 1 having a stationary contact 2, a movable contact arm 3 having a movable contact 4, a movable contact support member 5, an operating link 6, a stationary frame 8 rotatably supporting the movable contact support member 5, a stopper 10 for the movable contact arm 3 provided on the movable contact support member 5, a spring 11 engaged with the movable contact arm 3, a flexible conductor 12 connected with the end of the movable contact arm 3, and a stationary member 13. The contact structure of the switching devices shown in FIG. 1 and FIG. 2 has the spring 11 engaged between the movable contact arm 3 and the stationary member 13 and differs from the prior structure at the point of which the stopper 10 is provided at the side of the contacts 2 and 4 in connection with the pivot 7 of the movable contact arm 3.

Also, FIG. 2 shows an alternative embodiment to that of FIG. 1. In FIG. 1 the rotating pivot 7 of the movable contact arm 3 serves as the connecting pivot of the operating link 6, while in FIG. 2 the movable contact arm 3 is supported by the movable contact support member 5 with the pivot 7. The movable contact support member 5 and the operating link 6 are connected with the pivot 14, and thus the pivot 7 for the movable contact 3 and the pivot 14 for the operating link 6 are provided exclusively to establish the same effect as the pivot 7 of FIG. 1.

Figure 1A:
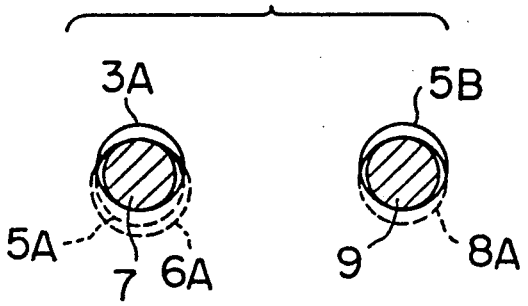
FIG. 1A and FIG. 2A show exaggerated conditions of the clearance around each of the pivots in FIG. 1 and FIG. 2.
Figure 2A:
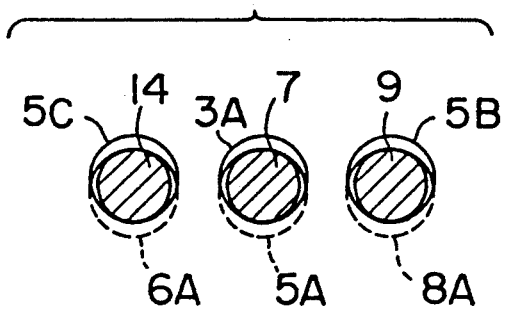

The condition of the clearances around the pivots are illustrated in FIG. 1A and FIG. 2A. In these figures, 3A is the aperture of the movable contact arm 3, 5A, 5B and 5C are the apertures of the movable contact support member 5, 6A is for the operating link 6, and 8A is for the support member 8.

The operation of the contact structure for a switching device of the present invention is described in accordance with FIG. 1 follows.

The contact pressure under the closed condition for the device in FIG. 1 is expressed with the following formula:

$$F=P\times L_1/L_2$$

where the operating force of the spring 11 is P, the distance between the pivot 7 and the spring 11 is $L_1$, and the distance between the pivot 7 and the contact is $L_2$.

Figure 3:
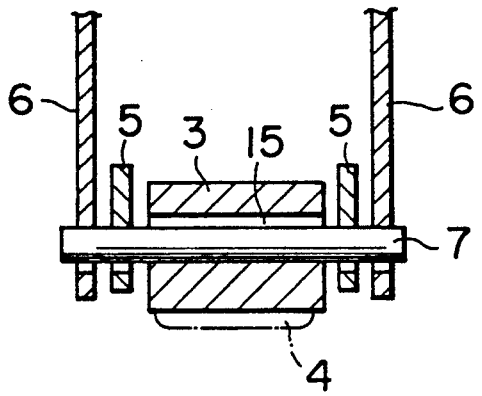
FIG. 3 and FIG. 4 show cross sections along the lines III—III and IV—IV in FIG. 1 and FIG. 2 respectively viewing into the arrow directions.
Figure 4:
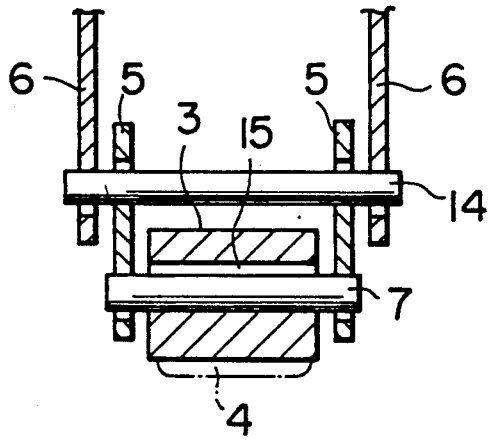

In the contact structure for a switching device of the present invention, a clearance between the aperture 15 of the movable contact arm 3 and the pivot 7 formed above the pivot 7 as seen in FIG. 3, therefore the desired pressure at the instant of contact initiation is immediately effective, and the force Q for pressing the pivot 7 with the movable contact arm 3 prior the contacting is expressed with the following formula:

$$Q=P\times A/B\ (A/B>1)$$

where the operating force of the spring 11 is P, the distance between the stopper 10 and the spring 11 is A, and the distance between the stopper 10 and the pivot 7 is B. From this formula the operating force of the spring 11 is increased to eliminate chattering causing a contact collision at the instant of closing and thus a contact pressure equal to normal contact pressure can be obtained just after the instant of closing.

Furthermore, as the mechanical resistance of the flexible conductor 12 usually operates in the same direction as that of the operating force P of the spring 11 just before the closing, this mechanical resistance works to increase the operating contact pressure in a desirable direction Also, right after the instant of the contact closing, the stop position of the movable contact arm 3 moves to the contact itself from the position of the stopper 10, but the operating direction of the force to the pivot 7 is not changed, therefore no closing chattering occurs.

Figure 5:
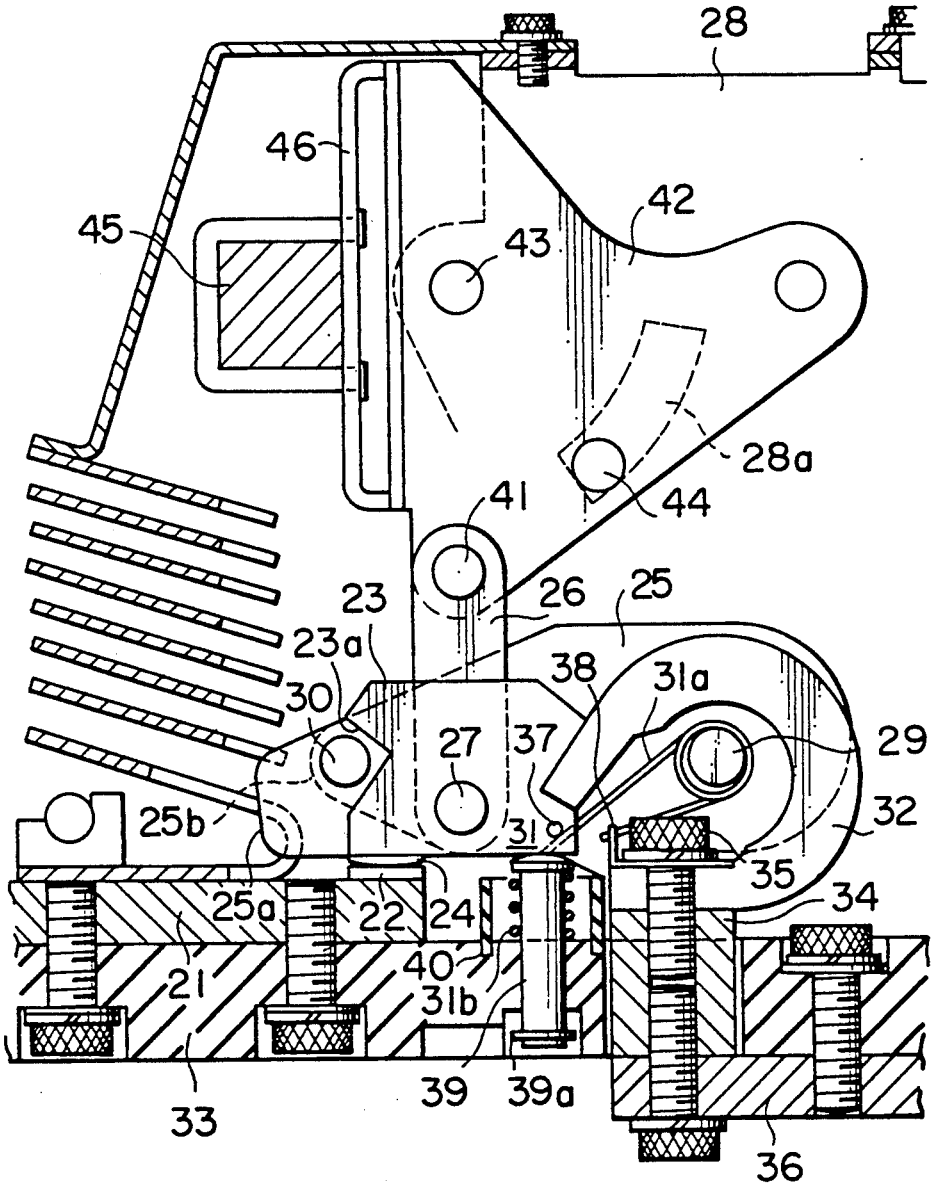
FIG. 5 and FIG. 6 show an alternative embodiment for the basic form of the present invention shown in FIGS. 1 and 2.
Figure 6:
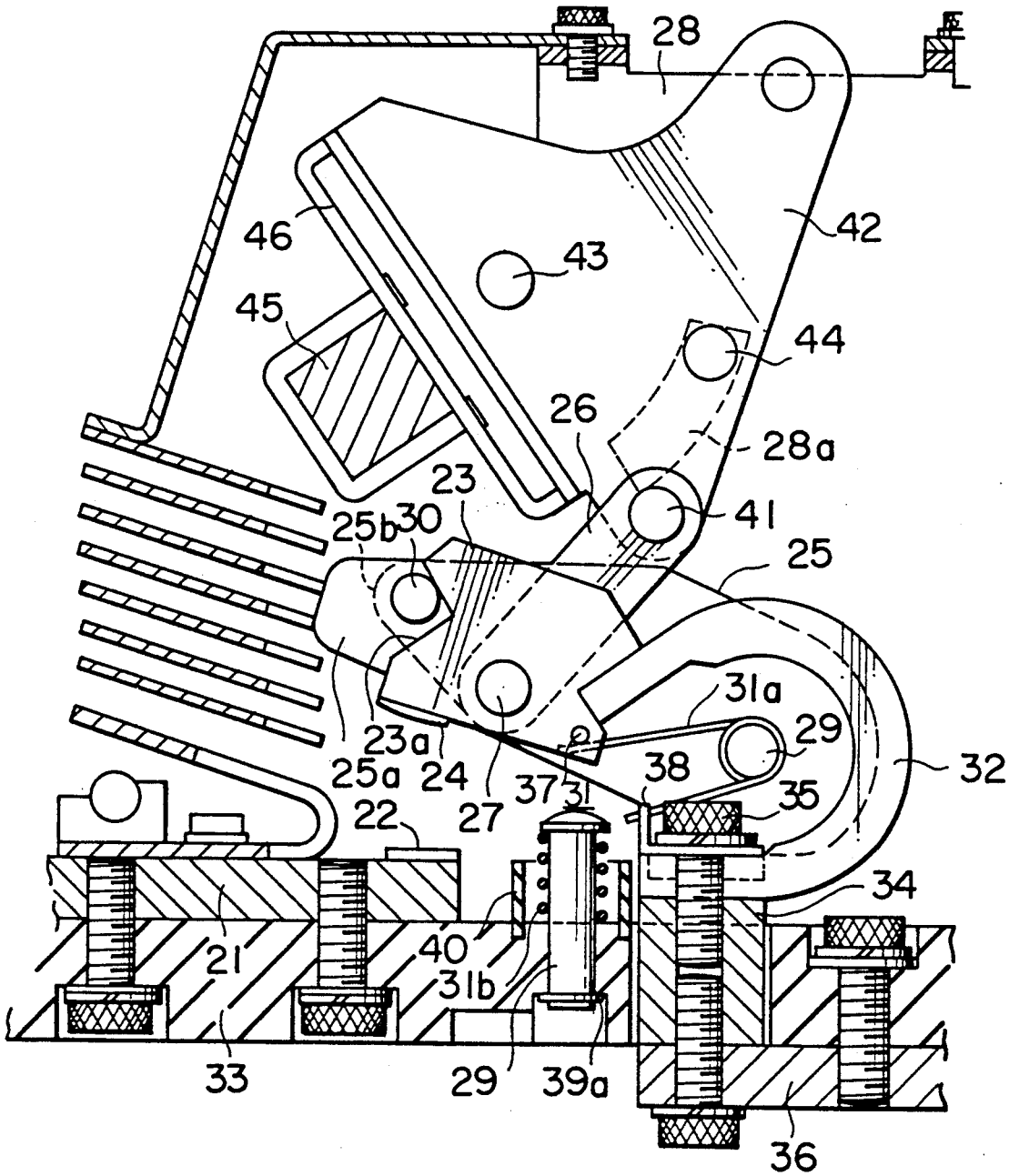
Figure 7:
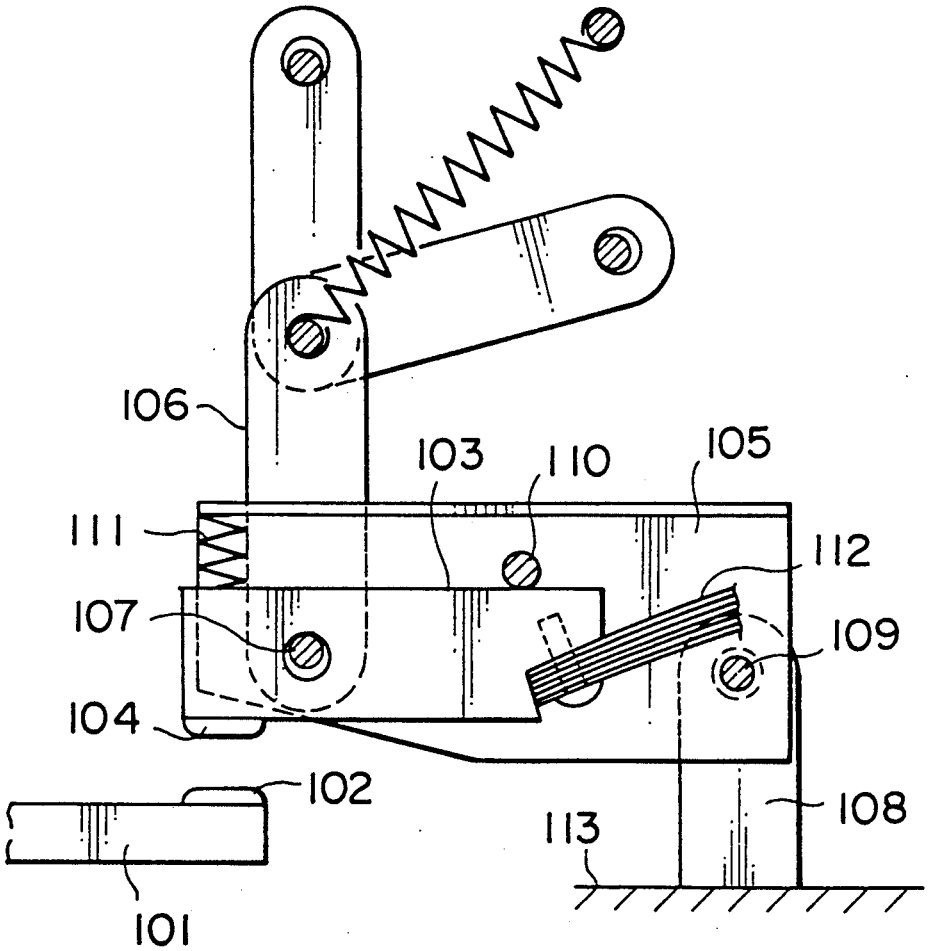
FIG. 7 PRIOR ART
FIG. 7, FIG. 8 and FIG. 9 are the cross-sectional views of the contact devices showing the basic forms of the spring device in the prior art.
Figure 8:
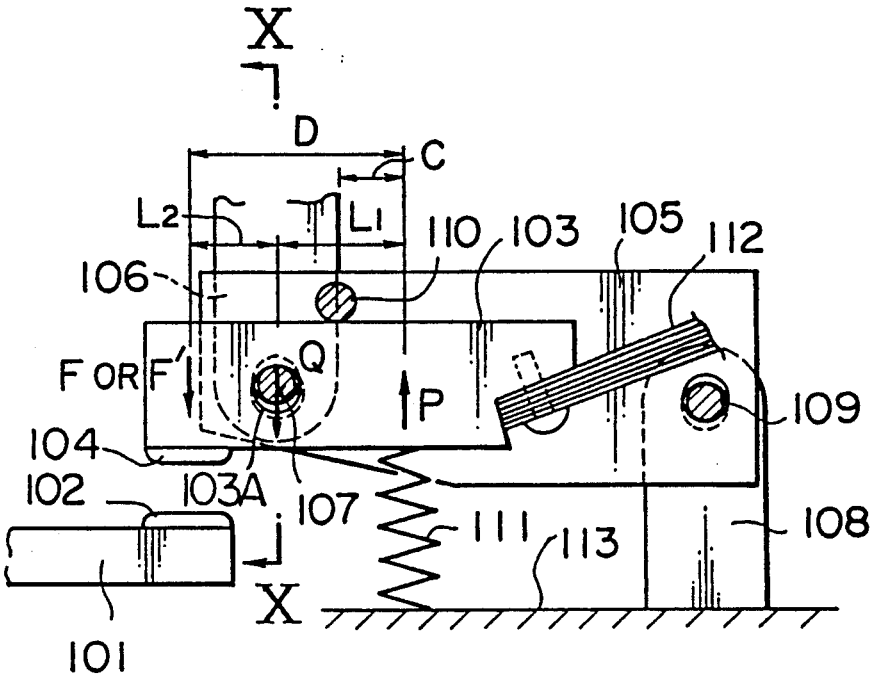
FIG. 8 PRIOR ART
Figure 8A:
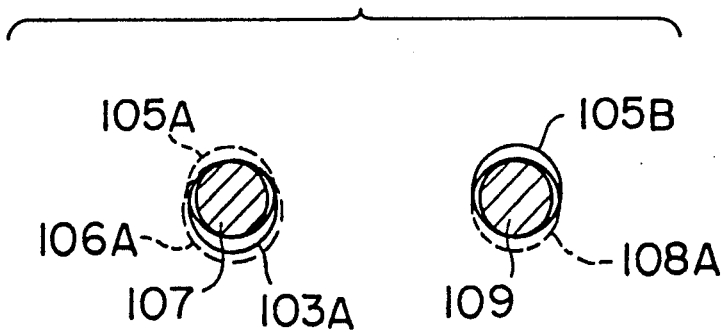
FIG. 8A PRIOR ART
FIG. 8A and FIG. 9A are partial views showing exaggerated conditions of the gap around each of the pivots in FIGS. 8 and 9.
Figure 9:
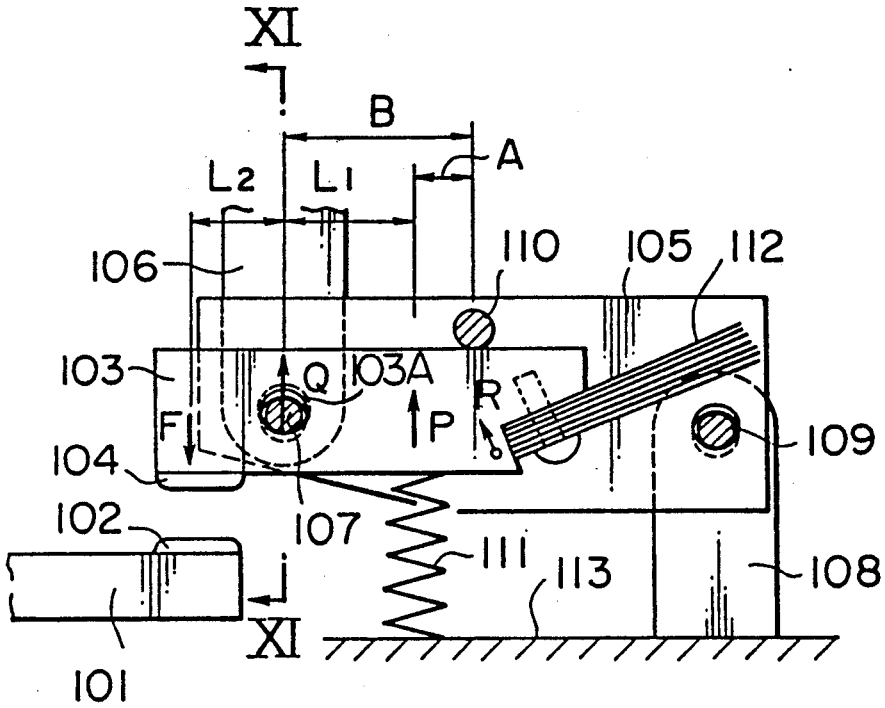
FIG. 9 PRIOR ART
Figure 9A:
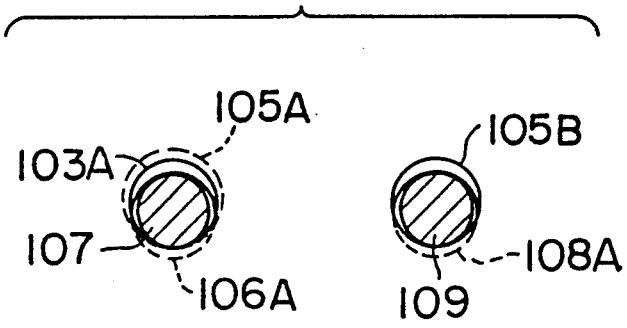
FIG. 9A PRIOR ART
Figure 10:
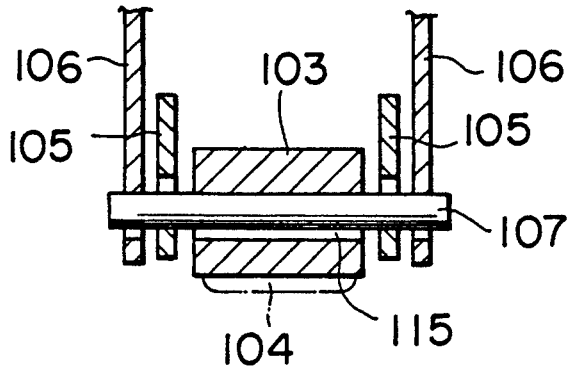
FIG. 10 PRIOR ART
FIG. 10 and FIG. 11 show the cross-sectional views along the lines X—X and XI—XI in FIG. 8 and FIG. 9 respectively shown in the direction of the arrow.
Figure 11:
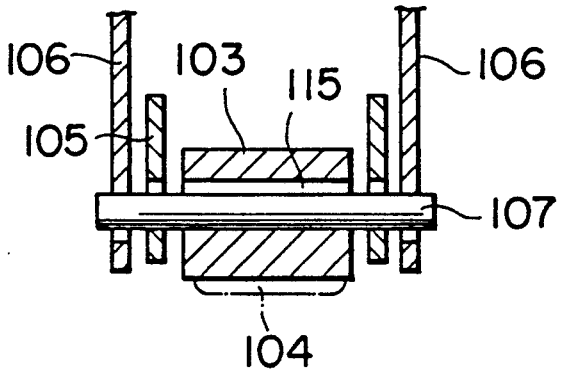
FIG. 11 PRIOR ART

In FIG. 5 and FIG. 6 of the drawings are shown preferred embodiments based on the afore said basic form of the contact structure for a switching device of the present invention shown in FIGS. 1 and 2. FIG. 5 and FIG. 6 are cross-sectional side views showing respectively the closed condition and the open condition of the contact structure.

As shown in FIG. 5 and FIG. 6, the contact device for switch of the present invention is provided with a stationary contact rod 21 having a stationary contact 22 at its one end on a base 33 formed of insulating material. Also, a movable contact arm 23 having a movable contact 24 for switching the stationary contact 22 is unitedly and rotatably connected with a lower operating link 26 of an operating mechanism and a movable contact support member 25 using a pivot 27.

The movable contact support member 25 is rotatably supported with a pivot 29 on a stationary frame 28, and is provided with a stopper 30 at its one end so as to associate with a notch 23*a* provided on the contacting side of the movable contact arm 23.

Furthermore, at the tail end of the movable contact arm 23 one end of an flexible conductor 32 is connected to form a round loop around the pivot 29, and the other end of such conductor 32 is connected to a connecting terminal 34 by a screw 35. The connecting terminal 34 extends through a base 33 and is connected with a terminal conductor 36 at its other side. A spring means 31 for applying a contacting force to the movable contact arm 23 is divided into a relatively weak first spring 31*a* and a relatively strong second spring 31*b*. The first spring 31*a* is a torsional spring and is so arranged around the pivot 29 of the movable contact support member 25 having one end engaged with a pin 37 provided on the tail end of the movable contact arm 23 and the other end engaged with a stationary member 38 as to operate between both open and closed positions.

Furthermore, the second spring 31*b* is arranged between the head portion of the pressure member 39, which can be engaged with the tail end of the movable contacting arm 23 and the base 33, the pressure member 39 being supported movably on the base 33. The pressure member 39 is usually raised up to the position restricted by a stopper 39*a* provided on the lower end thereof by the spring 31*b*. Such pressure member 39 operates only toward the contact direction and engages with the movable contact arm 23 a little ahead of the contact closing and disengages a little later than the contact separation An insulating cylinder 40 is provided on the base 33 to insulate and protect the pressure member 39.

The upper end of the lower operating link 26 is connected with an upper operating link 42 by a pivot 41. This upper operating link 42 is rotatably supported on the stationary frame 28 by a pivot 43 and a guide pin 44 provided on the link 42 is engaged within a guide recess 28*a* provided on the stationary frame 28. Furthermore, a crossbar 45 is provided to operatively rotate the multipoles as a unit by an operating mechanism (not shown), and the upper link 42 is rotated for opening and closing around the pivot 43 by an operating arm 46 provided as a unit with the crossbar 45.

Now, when the crossbar 45 is rotated in the anticlockwise direction from the closing condition as shown in FIG. 5 by the operating mechanism, the link 42 is rotated around the rotating pivot 43 together with the guide pin 44 sliding along the guide recess 28*a* to draw the lower link 26 and thus the movable contact support member 25 is rotated around the rotating pivot 29 in the clockwise direction up to the opening condition as shown in FIG. 6. In this condition, the pressure member 39 which had been engaged with the movable contact arm 23 in the closed position is separated from the movable contact arm 23, and the pressure member 39 is brought up by the action of the second spring 31*b* until it is stopped by the limiting means 39*a* but the mechanical connection to the movable contact on the movable contact arm 23 is isolated.

With the above mentioned contact structure for a switching device of the present invention, the movable contact arm 23 rotatably supported on the movable contact support member 25 by the pivot 27 is so constituted that the stopper means 30 is provided on the movable contact support member 25, capable to engage and disengage at one end on the contact 24 at one side of the pivot 27, and that the spring means 31 (31*a*, 31*b*) is provided between the movable contact member 23 and the stationary member 33 (38) at the other side of the pivot 27, having a direction of force for contacting the stationary and movable contact 22 and 24, and for separating the movable contact arm 23 as well, and all of the clearances existing in the movable contact member 23 itself and in the upper and lower operting links 42 and 26, can be excluded causing to produce a sufficient closing and opening instantaneous pressure.

Furthermore, together with the above-mentioned constitution of the movable contact arm, the stopper means 30 and the spring means 31, flexible conductor 32 is also connected by welding or soldering or by a screw to the movable contact arm 23 forming a round loop around the pivot 29 of the movable contact support member 25. Such looped conductor acts so as to expand its diameter by an electromagnetic force produced by a current through it and this force opposes and cancels the repulsive force occurring between the stationary and movable contacts 22 and 24, respectively, on the movable contact arm 23. Without such cancelling means, stationary and movable contacts 22 and 23 would blow open and result in wearing of the surfaces or welding together caused by an arc occurring between both contacts when the current is large enough in a short circuit condition.

Also, the springs for the movable contact member 23 must be ones that primarily impart sufficient force to the contact when it is closed, but are not so strong as to cause any severe interference upon closing. Thus, by dividing such spring means 31 into a relatively weak first spring 31*a* able to operate toward opening at any open or closed position and a relatively strong second spring 31*b* that operates only at and near the closing position, too much counter force for closing can be prevented allowing even further reductions in size of the operating mechanism. Accordingly, the defect in the conventional methods of having a compression spring always applying the opening force up to the open position allowing buckling due to the large expansion rate of the spring when closed can be ameliorated. Also, by this division into two types of springs, there are the advantages that the overexpansion of the stronger spring means 31*b* can be prevented by the provision of limiting means 39*a* relative to the the expansion thereof and that a stable operating force can be imparted over a wide range of rotational angles through the use of a torsion spring by the weaker spring means 31*a*.

Furthermore, the contact structure usually has its contact portions pressured by the situation of the springs after the initiation of contact and this situation must be assured even after some wear occurs in the contacts. The amount of this assurance is called a wipe distance, and accordingly this distance is shown as the relative displacement of the movable contact arm 23 to the movable contact support member 25 before and after closing. Although this is the relative angle of movement when the movable contact member is of the rotary contact type, this is practically shown as the displacement of the movable contact arm at a point apart from the pivot 27. In order to ascertain this amount of displacement, it is even more practical to only measure the gap between the stopper 30 and the abutting surface of the mobable contact arm 23 upon completion of closing. As it is assumed in the present invention that this stopper 30 is positioned to the outside of the movable contact arm 23, this gap can be observed, and by providing a protrusion or V-shaped notch 23*a* at a location apart from the arcing position of the movable contact member 23 with the lower face thereof abutting the stopper 30 without bringing the stopper 30 close to the area of arc generation, a stopper 30 that is not directly exposed to arcing can be formed without losing any of the facility in measuring the wipe distance.

What is claimed is:

1. In a contact structure for a switching device comprising; a stationary contact rod having a stationary contact; a movable contact arm rotatably supported by a pivot on a movable contact support member;

a movable contact provided at one side of said movable contact arm in relation to said pivot;

said stationary and movable contacts forming butt contacts;

said movable contact arm connected to a flexible conductor defining an electrical path when said switching device is closed or opened;

a mechanical link means engaging said movable contact support member for closing or opening said electrical path;

a contact spring means provided on said movable contact arm to bias said movable contact toward said stationary contact so as to produce a mechanical pressure there between when said switching device is closed;

a stopper means provided on said movable contact support member to prevent the rotation of said movable contact arm about said pivot when said switching device is opened and permits rotation of said movable contact arm about said pivot when said switching device is closed;

the improvement comprising said stopper means being located so as to engage with said one side of said movable contact arm, and said contact spring means being provided between another side of said movable contact arm in relation to said pivot and a stationary portion of said switching device thereby biasing said movable contact arm toward opening and eliminating chatter.

2. A contact structure for a switching device as claimed in claim 1, wherein said movable contact support member is a rotary member rotatably supported by a second pivot which is stationary and that said flexible conductor is formed in a round loop to surround said second pivot.

3. A contact structure for a switching device as claimed in claim 2, wherein said contact spring means comprises a relatively weak first spring means operating in all positions between opened and closed positions and a relatively strong spring means engaging shortly before reaching a closed condition in a closing operation and disengaging shortly after separation of the contacts in an opening operation.

4. A contact structure for a switching device as claimed in claim 1, wherein said movable contact arm has a protrusion of V-shaped notch, one side of said notch engaging with said stopper means in an opened condition of said movable contact.

5. A contact structure for a switching device as claimed in claim 3, wherein said first spring means is a torsion spring wound around said second pivot, and said second spring means is a compression spring provided with a limiting means for limiting excessive extension thereof.

* * * * *

UNITED STATES PATENT AND TRADEMARK OFFICE

CERTIFICATE OF CORRECTION

PATENT NO. : 5,012,053

DATED : April 30, 1991

INVENTOR(S) : Wasaburo Murai

It is certified that error appears in the above-identified patent and that said Letters Patent is hereby corrected as shown below:

In Claim 1, column 8, line 42 "there between" should be --therebetween--

Signed and Sealed this

Eighteenth Day of August, 1992

*Attest:*

DOUGLAS B. COMER

*Attesting Officer*

*Acting Commissioner of Patents and Trademarks*